US009019181B2

(12) United States Patent
Liu

(10) Patent No.: US 9,019,181 B2
(45) Date of Patent: Apr. 28, 2015

(54) ELECTROLUMINESCENT DISPLAY USING BIPOLAR COLUMN DRIVERS

(75) Inventor: Willy Liu, Mississauga (CA)

(73) Assignee: Ifire IP Corporation, Fort Saskatchewan, Alberta (CA)

( * ) Notice: Subject to any disclaimer, the term of this patent is extended or adjusted under 35 U.S.C. 154(b) by 0 days.

(21) Appl. No.: 13/164,076

(22) Filed: Jun. 20, 2011

(65) Prior Publication Data

US 2011/0249045 A1 Oct. 13, 2011

Related U.S. Application Data

(63) Continuation of application No. 11/530,739, filed on Sep. 11, 2006, now abandoned.

(60) Provisional application No. 60/715,608, filed on Sep. 12, 2005.

(51) Int. Cl.
*G09G 3/30* (2006.01)
*G09G 3/32* (2006.01)

(52) U.S. Cl.
CPC ..... *G09G 3/30* (2013.01); *G09G 3/3216* (2013.01); *G09G 2300/06* (2013.01); *G09G 2310/0254* (2013.01); *G09G 2310/0256* (2013.01); *G09G 2310/0275* (2013.01); *G09G 2320/0271* (2013.01); *G09G 2320/0276* (2013.01); *G09G 2330/021* (2013.01)

(58) Field of Classification Search
USPC ..... 345/36, 45, 76–81; 313/484–487, 313/498–502; 315/169.1–169.4
See application file for complete search history.

(56) References Cited

U.S. PATENT DOCUMENTS

| | | | | |
|---|---|---|---|---|
| 4,739,320 | A | 4/1988 | Dolinar et al. | |
| 5,999,150 | A | 12/1999 | Nighan et al. | |
| 6,621,228 | B2 | 9/2003 | Harada et al. | |
| 6,803,890 | B1 | 10/2004 | Velayudhan et al. | |
| 7,965,283 | B2 * | 6/2011 | Umezaki | 345/204 |
| 2005/0116902 | A1 | 6/2005 | Miyzawa | |
| 2005/0225519 | A1 | 10/2005 | Naugler | |

* cited by examiner

*Primary Examiner* — Ram Mistry
(74) *Attorney, Agent, or Firm* — Fay Sharpe LLP

(57) ABSTRACT

A driver apparatus for an electroluminescent display comprising a plurality of rows to be scanned and a plurality of columns which intersect the rows to form a plurality of pixels, comprises addressable row drivers, each row driver applying an output voltage to its associated row when addressed. The value of the output voltage is approximately equal to the numerical average of the threshold voltage for the electroluminescent display and the voltage required to provide the maximum desired pixel luminance for the electroluminescent display. Bipolar column drivers each supply an output voltage to its associated column. The output voltage is either positive or negative depending on the desired luminance of the pixels. The range of both positive and negative column output voltages is from zero volts to about one half of the difference between the threshold voltage and the voltage to provide the desired maximum pixel luminance for the electroluminescent display.

10 Claims, 3 Drawing Sheets

ELECTROLUMINESCENT DISPLAY USING BIPOLAR COLUMN DRIVERS

RELATED APPLICATIONS

This application is a continuation application of U.S. patent application Ser. No. 11/530,739, filed Sep. 11, 2006 now abandoned, which claims the benefit of U.S. Provisional Patent Application Ser. No. 60/715,608 filed on Sep. 12, 2005 for an invention entitled "Electroluminescent Display Using Bipolar Column Drivers".

FIELD

The present invention relates to an electroluminescent display using bipolar column drivers.

BACKGROUND

Electroluminescent displays are advantageous by virtue of their low operating voltage with respect to cathode ray tubes, their superior image quality, wide viewing angle and fast response time over liquid crystal displays, and their superior gray scale capability and thinner profile as compared to plasma display panels.

As shown in FIGS. 1 and 2, an electroluminescent display has two intersecting sets of parallel, electrically conductive address lines called rows (ROW 1, ROW 2, etc.) and columns (COL 1, COL 2, etc.) that are disposed on either side of a phosphor film encapsulated between two dielectric films. A pixel is defined as the intersection point between a row and a column. Thus, FIG. 2 is a cross-sectional view through the pixel at the intersection of row ROW 4 and column COL 4, in FIG. 1. Each pixel is illuminated by the application of a voltage across the intersection of the row and column defining the pixel using row and column drivers (not shown) coupled to the rows and columns.

Matrix addressing entails applying a voltage below the threshold voltage to a row while simultaneously applying a modulation voltage of the opposite polarity to each column that bisects that row. The voltages on the row and the columns are summed to give a total voltage in accordance with the illumination desired on respective sub-pixels, thereby generating one line of the image. An alternate scheme is to apply the maximum sub-pixel voltage to the row and apply a modulation voltage of the same polarity to the columns that intersect that row. The magnitude of the modulation voltage is up to the difference between the maximum voltage and the threshold voltage to set the pixel voltages in accordance with the desired image. In either case, once each row is addressed, another row is addressed in a similar manner until all of the rows have been addressed. Rows that are not addressed are left at open circuit. The sequential addressing of all rows constitutes a complete frame. Typically, a new frame is addressed at least about fifty (50) times per second to generate what appears to the human eye as a flicker-free video image.

In order to generate realistic video images with flat panel displays, it is important to provide the required luminosity ratios between gray levels where the driving voltage is regulated to facilitate gray scale control. This is particularly true for electroluminescent displays where gray scale control is exercised through control of the output voltage on the column drivers for the display.

Traditional thin film electroluminescent displays employing thin dielectric layers that sandwich a phosphor film between driving electrodes is not amenable to gray scale control through modulation of the column voltage, due to the very abrupt and non-linear nature of the luminance turn-on as the driving voltage is increased. By way of contrast, electroluminescent displays employing thick, high dielectric, constant dielectric layered pixels have a nearly linear dependence on the luminance above the threshold voltage, and are thus more amenable to gray scale control by voltage modulation. However, even in this case if the gray scale voltage levels are generated by equally spaced voltage levels then the luminance values of the gray levels are not in the correct ratios for video applications.

The gray level information in a video signal is digitally encoded as an 8-bit number or code. These digital gray level codes are used to generate reference voltage levels V.sub.g that facilitate the generation of luminance levels (Lg) for each gray level in accordance with an empirical relationship of the form:

$$Lg=f(V_g)=An^{\gamma} \quad \text{(Equation 1)}$$

where:

A is a constant;

n is the gray level code; and $\gamma$ is typically between 2 and 2.5.

An electroluminescent display driver with gray scale capability resembles a digital-to analog (D/A) device with an output buffer. The purpose is to convert an incoming 8-bit gray level code from the video source to an analog output voltage for electroluminescent display driving. There are various types of gray scale drivers employing different methods of performing the necessary digital-to-analog conversion. A preferred type and method uses a linear ramping voltage as a means of performing the D/A conversion. For this type of gray scale driver, the digital gray level code is first converted to a pulse-width through a counter operated by a fixed frequency clock. The time duration of the pulse-width is a representation of, and corresponds to, the digital gray level code. The pulse-width output of the counter in turn controls the turn-on of a capacitor sample-and-hold circuit which operates in conjunction with an externally generated linear voltage ramp to achieve the pulse-width to voltage conversion. Since the voltage ramp has a linear relationship between the output voltage and time, the pulse-width representation of the digital gray level code results in a linear gray level voltage at the driver output. The luminance created for each gray level is thus dependent on the relationship between the voltage applied to a pixel and the pixel luminance, which is dependent on the electro-optical characteristic of the electroluminescent display. This luminance-voltage characteristic is normally different from the ideal characteristic, and therefore Gamma correction is necessary.

The relationship between the voltage applied to a pixel and its luminance is typified by the curve in FIG. 3. To achieve proper color balance for the electroluminescent display, a Gamma correction is made to the linear voltage ramp to achieve the relationship between luminance and a gray level given by Equation 1. For the luminance versus voltage curve of FIG. 3, the linear voltage ramp is replaced by the non-linear voltage ramps shown in FIG. 4. The non-linear voltage ramps can be generated using analogue circuitry such as that taught in co-pending U.S. patent application Publication No. 2004/0090402 to Cheng or by other means as may be known in the art. The non-linear voltage ramps are different for positive and negative row voltages because in the former case the pixel voltage is the difference between the row and column voltages and in the latter case the pixel voltage is the sum of the row and column voltages. The luminance begins to rise above the threshold voltage in a non-linear fashion for the first few volts above the threshold voltage, and then rises in an approximate linear fashion before saturating at a fixed luminance. The portion of the curve used for electroluminescent display operation is the initially rising portion and the linear portion. The effects of differential loading of the driver outputs complicate the relationship. To negate the effect of variable loading and to improve the energy efficiency of the electroluminescent display, a driver employing a sinusoidal drive voltage with a resonant energy recovery feature is typically employed. Such a driver is disclosed in U.S. Pat. No. 6,448,950 to Cheng and U.S. patent application Publication No. 2003/0117421 to Cheng, the contents of which are incorporated herein by reference. U.S. patent application Publication No. 2004/0090402 to Cheng teaches a method and apparatus to realize the necessary Gamma correction of an electroluminescent display panel conveniently at the D/A conversion stage by replacing the normal linear voltage ramp with a special 'double-inverted-S' non-linear voltage ramp. The use of this non-linear voltage ramp enables adjustment of the voltages for the gray levels to generate a gray scale response similar to that described by the empirical relationship given by Equation 1.

As described in U.S. Pat. No. 6,448,950 to Cheng, a major portion of the power consumed by passively addressed electroluminescent displays is fed through the column drivers due to a parasitic capacitive coupling between the columns and the non-addressed rows. This patent teaches a means to reduce this power consumption by providing a sinusoidal driving waveform to minimize peak current and to recover a major portion of the energy through a resonant energy recovery circuit. Co-pending U.S. Provisional Patent Application No. 60/646,326 filed on Feb. 23, 2005 teaches a means to increase further the energy efficiency by ensuring that as much of the energy from the electroluminescent display panel is recovered by the energy recovery circuit and not dissipated in parallel parasitic current loops through ground and through the supply voltage lines for the drivers. Although, these measures provide for energy recovery, they do not reduce the current flow through the drivers to zero. As will be appreciated, improvements in electroluminescent display energy efficiency and cost reductions in the column drivers may also be realized if the current flowing from the output of the column drivers can be reduced.

Other techniques for driving electroluminescent displays have been considered. For example, U.S. Pat. No. 6,636,206 to Yatabe discloses a system and method of driving a display device so as to display a gray scale image without causing a significant increase in power consumption. Pixels disposed at locations corresponding to respective intersections of a plurality of scanning lines extending along rows and a plurality of data lines extending along columns are driven. A single scanning line is selected during one horizontal scanning period and a selection voltage is applied to the scanning line for one half of the scanning period. Another adjacent scanning line is selected during the next horizontal scanning period and the selection voltage is applied to the scanning line for the other half of the scanning period. At the same time, a turn-on and turn-off voltage is applied to a pixel at a location corresponding to the selected scanning line such that the turn-on voltage is applied for a length corresponding to a gray level in the period during which the selection voltage is applied. The turn-off voltage is applied during the remaining period.

U.S. Pat. No. 5,315,311 to Honkala discloses a method and apparatus for reducing power consumption in an AC-excited electroluminescent display. Each row of the display matrix is alternatively driven by positive and negative row drive pulses. The magnitudes of successive row drive pulses are different. Each column of the display matrix is driven individually by modulation voltage pulses synchronized to the row addressing sequence. The modulation voltage pulses have a maximum amplitude and an "on"-state polarity equal to that of the larger-magnitude row drive pulse.

U.S. Pat. No. 6,803,890 to Velayudehan et al. discloses a system and method for addressing and achieving gray scale in an electroluminescent display using a waveform having at least one positive ramped modulating pulse and zero or more non-ramped modulating pulses. The pulses are applied to the electroluminescent display successively to form a scan pulse that is applied across an electrode row and electrode column.

Although various techniques for driving electroluminescent displays exist, improvements are continually being sought. It is therefore an object of the present invention to provide a novel electroluminescent display using bipolar column drivers.

SUMMARY

The electroluminescent display driving method and apparatus enables a reduction in the output current of column drivers by splitting the required column voltage into positive and negative portions and adjusting the row voltage commensurately, so that the display threshold voltage is determined as being the difference between the absolute value of the row voltage and the maximum absolute value of the negative column voltage, and so that the voltage for maximum luminance is the sum of the absolute value of the row voltage and the absolute value of the column voltage.

In one embodiment, the rows of the electroluminescent display are addressed sequentially, and the columns bisecting an addressed row are simultaneously addressed. Column drivers provide a bipolar voltage output so that the threshold voltage for the electroluminescent display pixels, defined as the voltage for the onset of light emission, is equal to the difference between the absolute value of the row voltage and the maximum absolute value of the voltage from the positive output of the column drivers and further so that the voltage for maximum luminance of an electroluminescent display pixel is equal to the sum of the absolute value of the row voltage and the maximum absolute value of the voltage from the negative output of the column drivers.

In this embodiment, the voltage of the addressed row may be alternately positive and negative with respect to a common reference voltage, which may be ground. The electroluminescent display may also be provided with gray scale capability wherein the number of gray levels are divided between the positive and negative outputs of the column drivers. The division is made on the basis that the gray level selection probability in typical video applications reaches a peak in mid-range gray levels. As a result, a gray level near the most commonly selected gray level is chosen to correspond to a zero column voltage. This results in about one half of the gray levels corresponding to a negative column voltage and about one half of the gray levels corresponding to a positive column voltage. It will be appreciated that this division can of course be adjusted based on a detailed analysis of typical gray level distribution for video.

The gray levels may be generated using a voltage ramp where the end of the voltage ramp, which defines the voltage level for each of the gray levels assigned to each of the positive and negative outputs of the column drivers, is timed such that the times for the end of the voltage ramp for these gray levels are spaced substantially over the entire duration of the period during which a row is addressed. The voltage ramp used to define the gray levels may be non-linear with respect to time to account for the relationship between display luminance and the driving voltage. Alternatively, a tailored non-linear relationship between the voltage at the end of the voltage ramp and the gray levels can be realized by employing a non-linear voltage ramp and a variable frequency clock using a voltage controlled oscillator to vary the clock frequency over the duration of the voltage ramp. The shape of the voltage ramp curve with respect to time or the frequency of the voltage controlled oscillator is adjusted in accordance with a sensor incorporated into the electroluminescent display that generates a signal proportional to the luminance for a particular driving voltage and by providing feedback to the voltage ramp generator or the voltage controlled oscillator to vary the clock frequency in accordance with the required gray levels.

In one form, the sensor comprises an extra calibration pixel fabricated on the electroluminescent display substrate outside of the video portion of the electroluminescent display. The extra calibration pixel has the same operational and aging characteristics as the electroluminescent display pixels. A photo-diode or similar light measuring device is mounted on the rear of the electroluminescent display substrate immediately behind the extra calibration pixel or in proximity to the extra calibration pixel so that it measures light transmitted through the electroluminescent display substrate that is proportional to the luminance of the extra calibration pixel.

Accordingly, in one aspect there is provided a driver apparatus for an electroluminescent display comprising a plurality of rows to be scanned and a plurality of columns which intersect said rows to form a plurality of pixels, said driver apparatus comprising:

addressable row drivers applying an output voltage to the rows, the value of which is greater than the threshold voltage for the electroluminescent display and less than that required to provide the maximum desired luminance for a pixel; and bipolar column drivers supplying an output voltage to the columns, the output voltage being either a positive or negative voltage depending on the desired luminance of the pixels.

According to another aspect there is provided a driver apparatus for an electroluminescent display comprising a plurality of rows to be scanned and a plurality of columns which intersect said rows to form a plurality of pixels, said driver apparatus comprising:

addressable row drivers, each row driver applying an output voltage to its associated row when addressed, the value of which is approximately equal to the numerical average of the threshold voltage for the electroluminescent display and the voltage required to provide the maximum desired pixel luminance for the electroluminescent display; and bipolar column drivers, each supplying an output voltage to its associated column, the output voltage being either positive or negative depending on the desired luminance of the pixels, wherein the range of both positive and negative column output voltages is from zero volts to about one half of the difference between the threshold voltage and the voltage required to provide the desired maximum pixel luminance for the electroluminescent display.

According to yet another aspect there is provided an electroluminescent display comprising:

a plurality of rows to be scanned;

a plurality of columns which intersect said rows to form a plurality of pixels;

addressable row drivers each applying an output voltage to its associated row when addressed; and bipolar column drivers each supplying an output voltage to its associated column, wherein during row addressing the output voltage of each column driver is split into positive and negative portions and the row voltage is adjusted commensurately, so that the electroluminescent display threshold voltage is the difference between the absolute value of the row voltage and the maximum absolute value of the negative column voltage and so that the voltage for maximum pixel luminance is the sum of the absolute value of the row voltage and the absolute value of the column voltage.

According to yet another aspect there is provided a driver apparatus for an electroluminescent display comprising a plurality of rows to be scanned and a plurality of columns which intersect said rows to form a plurality of pixels, said driver apparatus comprising:

addressable row drivers each applying an output voltage to its associated row, the value of which corresponds to a gray level near the middle level for an electroluminescent display pixel; and bipolar column drivers having a voltage modulation type gray scale capability, the column drivers supplying an output voltage to the pixels on an addressed row, the output voltage being either positive or negative depending on the desired gray level of the pixels, the range of column voltage when negative being from zero volts to the difference between the threshold voltage and the voltage corresponding to a gray level near the middle level for the electroluminescent display pixel and when positive being from zero volts to the difference between the voltage corresponding to the highest (brightest) gray level and the voltage corresponding to the gray level near the middle level for the electroluminescent display pixel.

According to yet another aspect there is provided a bipolar column driver output stage comprising:

positive and negative ramp control circuits receiving gray scale information and being responsive to frame polarity input so that only one of said ramp control circuits is enabled at a time, said ramp control circuits also receiving end point and voltage ramp signals;

a charge store coupled to the ramp control circuits and receiving the voltage ramp output by the enabled ramp control circuit; and an output buffer responsive to said charge store to modulate a voltage supply thereby to generate output column voltage pulses.

According to still yet another aspect there is provided a method of driving a row of pixels of an electroluminescent display comprising a plurality of rows and a plurality of pixels intersecting said rows to define a plurality of pixels, said method comprising:

addressing the pixel row by applying an output voltage thereto; and applying either a positive or a negative voltage to the columns intersecting the addressed row depending on the desired gray level of the pixels in the addressed row.

The electroluminescent display drivers provide for improved energy efficiency for video applications and for improved gray scale control by modulation of the voltage applied to the column electrodes using a non-linear or stepwise linear voltage ramp.

BRIEF DESCRIPTION OF THE DRAWINGS

Embodiments will now be described more fully with reference to the accompanying drawings, in which.

DETAILED DESCRIPTION OF THE EMBODIMENTS

Figure 1:
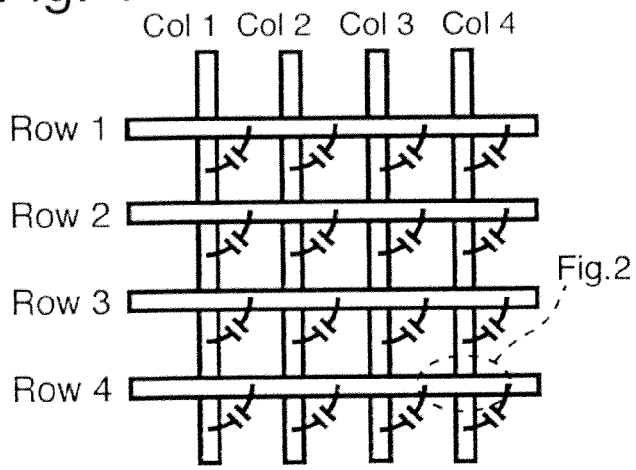
FIG. 1 is a plan view of a typical arrangement of rows and columns of pixels forming part of an electroluminescent display.
Figure 2:
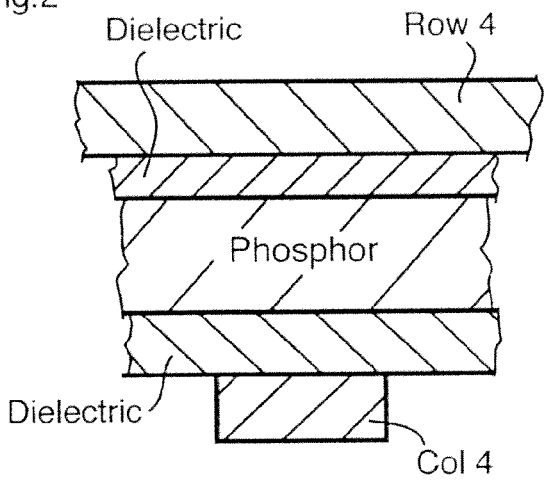
FIG. 2 is a cross-section through a single pixel of the electroluminescent display of FIG. 1.
Figure 3:
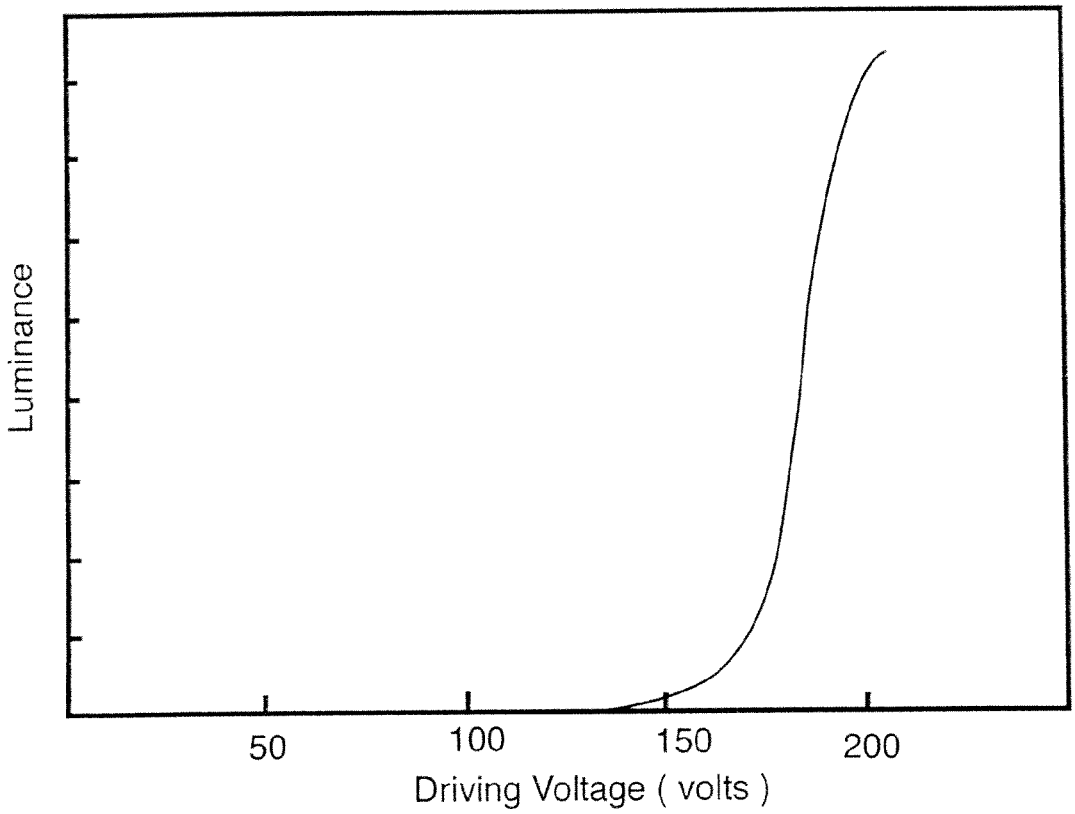
FIG. 3 is a luminance versus applied voltage curve for the electroluminescent display of FIG. 1.

To improve the efficiency of electroluminescent displays of the type such as that shown in FIG. 1, bipolar column driver output stages or simply bipolar column drivers are used to drive the column electrodes or address lines during matrix addressing. The use of bipolar column drivers reduces the power consumption of the electroluminescent display and reduces the current flow in the column drivers by reducing the maximum voltage that must be output from the column drivers.

In one embodiment, the electroluminescent display employs row drivers that set the row voltage to a value that is between the threshold voltage for the electroluminescent display and the voltage required for maximum display luminance. Bipolar column drivers with voltage modulation gray scale capability are employed. The bipolar column drivers set the column voltage to a positive or negative value, depending on whether the required gray level for the electroluminescent display pixel defined by the intersection of that column and the addressed row is greater than or less than the gray level when the electroluminescent display pixel voltage is equal to the row voltage. The bipolar column drivers differ from those of the prior art in that they have a bipolar output. The bipolar column drivers may also have a substantially different voltage ramp for the negative polarity output than they do for the positive polarity output to accommodate the non-linear nature of gray levels. On the assumption that the row and column voltages are measured with respect to ground or a common reference voltage and if the row voltage is positive, then the lowest gray level corresponds to the highest positive voltage output from a bipolar column driver and the highest gray level corresponds to the lowest negative output voltage from the bipolar column driver. The polarity of the row voltage may be alternated from frame to frame to minimize the average applied voltage to the row for minimization of electroluminescent display degradation due to electric field assisted diffusion of atomic species in the electroluminescent display structure. The column voltages therefore may also be correspondingly alternated from frame to frame. Separate voltage ramp generating circuits can be employed for positive and negative column output voltages to achieve the required gray scale fidelity. The voltage ramp used to define the gray levels may be non-linear with respect to time to account for the relationship between display luminance and the driving voltage. Alternatively, a tailored non-linear relationship between the voltage at the end of the voltage ramp and the gray levels can be realized by employing a non-linear voltage ramp and a variable frequency clock using a voltage controlled oscillator to vary the clock frequency over the duration of the voltage ramp. The shape of the voltage ramp curve with respect to time or the frequency of the voltage controlled oscillator is adjusted in accordance with a sensor incorporated into the electroluminescent display that generates a signal proportional to the luminance for a particular driving voltage and by providing feedback to the voltage ramp generator or the voltage controlled oscillator to vary the clock frequency in accordance with the required gray levels.

The sensor may comprise an extra calibration pixel fabricated on the electroluminescent display substrate outside of the video portion of the electroluminescent display. The extra calibration pixel has the same operational and aging characteristics as the electroluminescent display pixels. A photodiode or similar light measuring device is mounted on the rear of the electroluminescent display substrate immediately behind the extra calibration pixel or in proximity to the extra calibration pixel so that it measures light transmitted through the electroluminescent display substrate that is proportional to the luminance of the extra calibration pixel.

Figure 5:
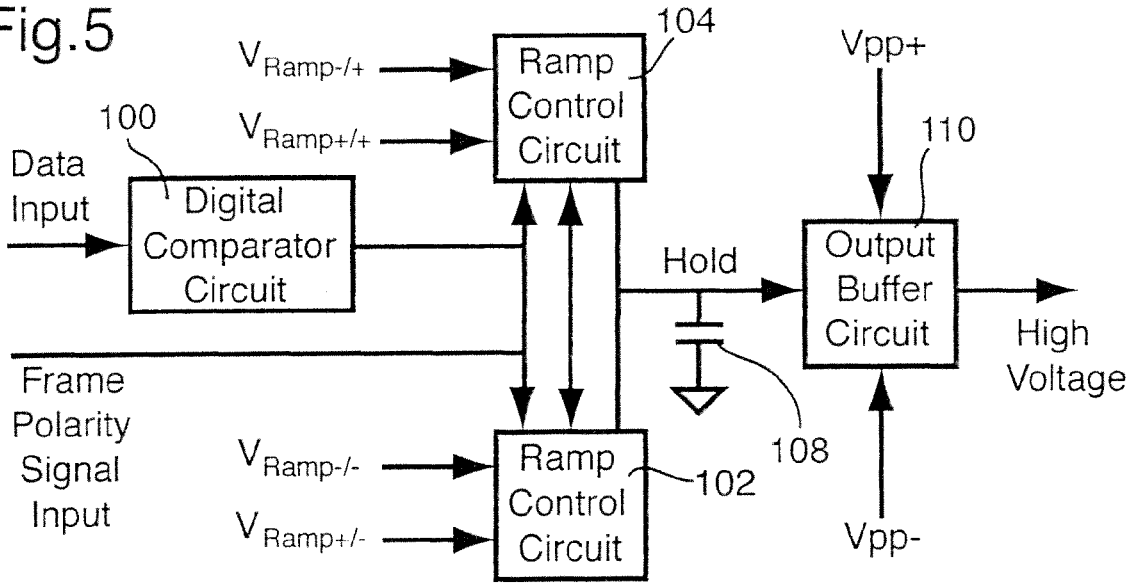
FIG. 5 is a block diagram of a bipolar column driver output stage.

FIG. 5 illustrates one of the bipolar column drivers. As can be seen, video data with gray scale information is provided as input to a digital comparator circuit 100. The output from the comparator circuit 100 is input into two ramp control circuits 102 and 104, one for negative row voltage pulses and the other for positive row voltage pulses. To determine the end point for positive and negative column driver output voltage ramps, Vramp+/+ and Vramp+/−. inputs are provided to the ramp control circuit 104 for the positive row voltage pulses. For positive and negative column driver output voltage ramps, Vramp−+. and Vramp−/− inputs are provided to the ramp control circuit 102 for the negative row voltage pulses. A frame polarity signal is input to the ramp control circuits 102 and 104 to select the active ramp control circuit. The output voltage ramps from the ramp control circuits 102 and 104 charge a hold capacitor 108 so that the desired gray level voltages determined on the basis of the input video data are input to an output buffer circuit 110, which modulates column voltage supplies Vpp+ and Vpp− to provide voltage pulses with the correct amplitude and polarity at a suitably low output impedance, to the column electrodes thereby to drive the electroluminescent display columns.

The use of bipolar column drivers reduces power consumption of the electroluminescent display for video applications since on average, the column voltage to generate the statistical distribution of gray levels typical of a video image is for a large fraction of the time close to half of the column voltage for maximum luminance. The power delivered through the columns is much greater than the power delivered through the rows, since the rows are addressed sequentially, with the non-addressed rows remaining at open circuit during electroluminescent display operation so that only the pixels on the addressed row are charged, whereas the columns are addressed simultaneously while a selected row is addressed, causing partial charging of all of the non-addressed rows as well as the addressed row due to capacitive coupling of the columns through the intersecting rows. This parasitic power drain to the non-addressed rows is greatest when half of the column outputs are at or near zero volts and the other half are at or near their maximum voltage.

The bipolar column drivers reduce this parasitic drain by setting the row voltage near the most frequently set voltages for the pixels so that the column voltages will be on average closer to zero.

The use of bipolar column drivers also enables the possibility of using a smaller silicon die for the column drivers with a defined number of channels since the total voltage ramp range is reduced. In large format high resolution displays such as those for high definition television, the voltage ramp rate must be sufficiently fast to allow the required gray level voltage to be reached during the time allowed for addressing each row. This together with the display capacitance determines the required output current for the column drivers so that the required voltage ramp rate is achieved. The required current in turn establishes the required silicon area for FET based column drivers to allow construction of a gate of sufficient width to minimize $I^2R$ losses and thus, inhibit excessive heat generation in the column drivers. Since the electroluminescent display represents a capacitive load on the column drivers, the output current from the column drivers is proportional to the rate of change of voltage in the gray scale generating ramp. Thus the rate of change in voltage, dV/dt, is proportional to the maximum voltage that a particular column driver output can be called upon to deliver, and inversely proportional to the time available to ramp the voltage to this level. The use of bipolar column drivers also reduces the maximum output current that can be demanded by reducing the maximum voltage that may be required. By adjusting the clock that determines the end-point for the voltage ramp for a particular gray level so that the highest gray level for each of the positive output and negative output column drivers is reached only at or near the maximum amount of time available to address each row, dV/dt can be reduced with respect to that for an electroluminescent display using unipolar column drivers in proportion to the reduction in maximum positive or negative voltage demanded from the column driver in question.

Embodiments are illustrated by the following examples, which are not intended to be limiting, but merely to provide illustrations of certain useful embodiments.

Example 1

This example illustrates a particular embodiment where the required maximum negative and positive output voltages for the column drivers are nearly equal, and where the voltage versus luminance curve is non-linear. In this case, there will be a significantly larger number of gray levels provided by one polarity of output from the column drivers than from the other. The gray levels are generated by terminating a linear voltage ramp in the column driver output using a digital clock with equally spaced gray level codes. If 20% of the gray levels for the electroluminescent display are provided by one polarity and 80% by the other polarity, then, relative to the requirements for a similar display employing unipolar column drivers, the spacing between gray level codes for the polarity providing 20% of the gray levels can be increased by up to a factor of five (5) and the spacing between gray level codes for the other polarity can be increased by up to 25%. If this is done and with the assumption that the maximum voltage for each of the positive output and negative outputs of the column drivers is 50% of that for the column drivers for a similar display operated using unipolar column drivers, dV/dt and hence the maximum current demand for the bipolar column drivers is only 50% of that for unipolar column drivers. Since the maximum power dissipation is proportional to $I^2R$, the corresponding reduced instantaneous power level is 25% of that for unipolar column drivers driving a similar display for both positive and negative outputs of the bipolar column drivers.

The required silicon area for the bipolar column drivers is determined in part by the instantaneous power dissipation requirement and in part by the average power dissipation requirement averages over a frame, depending on the heat flow dynamics within the column driver chip and the heat sinking efficiency for the column driver. However, the above analysis shows by the maximum power dissipation, the reduction in the maximum required power allows for a substantial reduction in the required silicon area, and hence a significant reduction in the cost of the column drivers, which represent a major portion of the cost of large format high resolution displays.

Example 2

Figure 4:
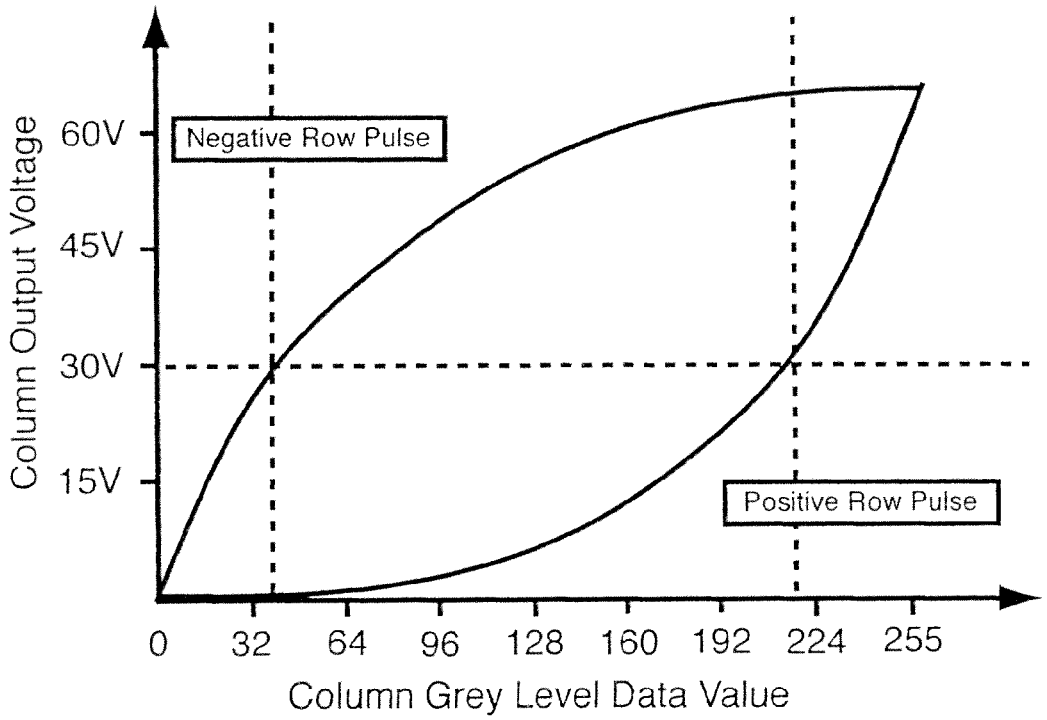
FIG. 4 shows voltage ramp curves applied to the output of unipolar column drivers during the application of a negative row voltage and during the application of a positive row voltage to generate gray scale luminance from the luminance versus voltage curve of FIG. 3.
Figure 6:
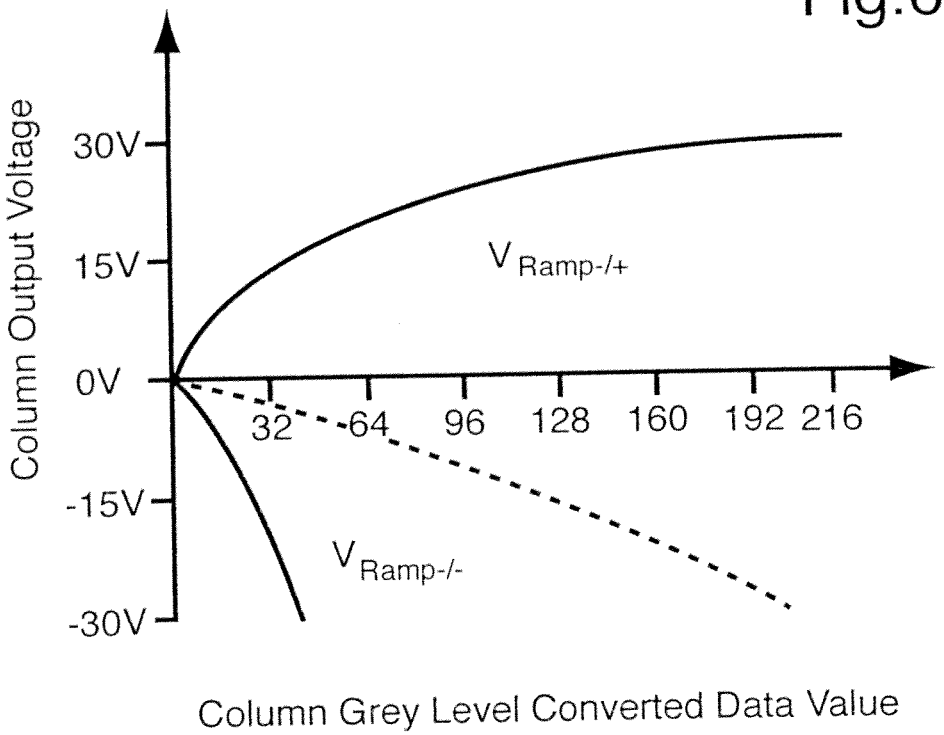
FIG. 6 shows voltage ramp curves applied to a positive output and to a negative output of the bipolar column driver output stage of FIG. 5 during the application of a negative row voltage pulse to generate the same gray scale luminance as the unipolar column drivers referenced with respect to FIG. 4.
Figure 7:
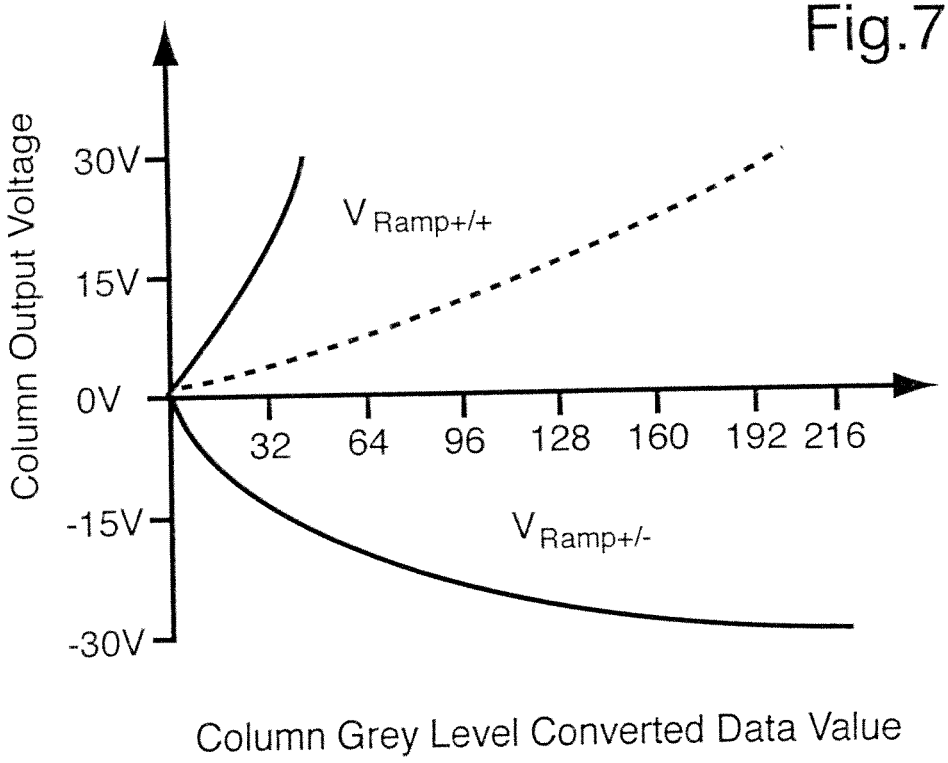
FIG. 7 shows voltage ramp curves applied to the positive output and to the negative output of the bipolar column driver output stage of FIG. 5 during the application of a positive row voltage pulse to generate the same gray scale luminance as the unipolar column drivers referenced with respect to FIG. 4.

This example illustrates gray scale ramps for use with bipolar column drivers to provide the necessary Gamma correction for a full color display employing bipolar column drivers. The ramps are different for positive and for negative applied row voltages, since in one case the pixel voltage is the algebraic sum of the column and row voltages, and in the other case the pixel voltage is the difference between the row and column voltages. FIGS. 6 and 7 show how the required voltage ramps to generate good color fidelity with unipolar column drivers as shown in FIG. 4 can be adapted for use with bipolar column drivers. The horizontal dotted line on FIG. 4 shows the division of the unipolar column driver voltage range between the ranges for positive and negative voltage output for the corresponding bipolar column driver. The two vertical dotted lines on FIG. 4 show the corresponding division of digital clock counts corresponding to gray levels for negative and for positive row voltage pulses.

The solid curves in FIG. 6 show the direct transposition of the unipolar voltage ramp of FIG. 4 for negative row voltage pulses for an equivalent bipolar column driver. The dotted line shows a five (5) times scaling of the digital clock counts for the voltage ramp for the negative output, which has the smaller number of gray levels, so that the voltage ramp extends over a greater fraction of the duration of a row pulse to reduce dV/dt. For negative row voltage pulses, the positive bipolar column driver output voltage $V_b$−/+(n) for the $n^{th}$ clock count is given in terms of the unipolar column driver output voltage $V^u$− as:

$$V^b-/+(n)=V^u-(n-40)$$

Also for negative row voltage pulses, the scaled negative bipolar column driver output voltage is given by:

$$V^b-/-(n)=V^u-(40-n/5)-V^u-(40)$$

In a similar manner the solid curves in FIG. 7 show the direct transposition of the unipolar voltage ramp of FIG. 4 for positive row voltage pulses for an equivalent bipolar column driver. In this case the negative bipolar column driver output voltage $V^b$+/−(n) for the $n^{th}$ clock count is given in terms of the unipolar column driver output voltage $V^u$+ for the $n^{th}$ clock count as:

$$V^b+-(n)=V^u+(n-40)$$

The scaled positive bipolar column driver output voltage (dotted line) is given by:

$$V^b+/+(n)=V^u+(40)-V^u-(40-n/5).$$

Although preferred embodiments have been described, those of skill in the art will appreciate that variations and modifications may be made without departing from the spirit and scope thereof as defined by the appended claims.

What is claimed is:

1. A driver apparatus for an electroluminescent display comprising a plurality of rows to be scanned and a plurality of columns which intersect said rows to form a plurality of pixels, said driver apparatus comprising:

addressable row drivers each connected to an associated row, each row driver applying a row voltage to its associated row when addressed, the value of the row voltage being approximately equal to a numerical average of a threshold voltage for the electroluminescent display and a voltage required to provide a maximum desired pixel luminance for the electroluminescent display; and bipolar column drivers each connected to an associated column, each column driver supplying a column voltage to its associated column, the column voltage being either a positive or negative voltage ramp depending on a desired luminance of the pixel intersecting the associated column that is being addressed, wherein a range of both positive and negative voltage ramps is from zero volts to about one half of the difference between the threshold voltage and the voltage required to provide the desired maximum pixel luminance for the electroluminescent display, wherein during generation of a frame, the row drivers are addressed so that the row voltage is applied in sequence to the rows and while the row voltage is applied to a selected row, the column drivers that are connected to columns that intersect the selected row are conditioned to simultaneously supply the column voltages to the columns, the column voltages comprising both positive and negative voltages.

2. A driver apparatus according to claim 1 wherein shapes of the positive and negative voltage ramps differ.

3. A driver apparatus according to claim 2 wherein the positive and negative voltage ramps are non-linear.

4. A driver apparatus according to claim 2 further comprising a sensor generating a signal proportional to an electroluminescent display luminance for a particular driver voltage, said signal being used to adjust the shapes of the positive and negative voltage ramps.

5. A driver apparatus according to claim 4 wherein said sensor is a calibration pixel on said electroluminescent display.

6. An electroluminescent display comprising:

a plurality of rows to be scanned;

a plurality of columns which intersect said rows to form a plurality of pixels;

addressable row drivers, each row driver applying a row voltage to its associated row when addressed; and bipolar column drivers, each column driver supplying a column voltage to its associated column, wherein during row addressing over a frame, the row drivers are addressed so that the row voltage is applied in sequence to the rows and while the row voltage is applied to a selected row, the column drivers that are connected to columns that intersect the selected row are conditioned to simultaneously supply the column voltages to the columns, the column voltages comprising both positive and negative voltage ramps and wherein the row voltage is adjusted commensurately, so that a threshold value of the electroluminescent display is the difference between an absolute value of the row voltage and a maximum absolute value of a negative column voltage and so that a voltage for maximum pixel luminance is the sum of the absolute value of the row voltage and an absolute value of the column voltage.

7. An electroluminescent display according to claim 6 wherein shapes of the positive and negative voltage ramps differ.

8. An electroluminescent display according to claim 7 wherein the positive and negative voltage ramps are non-linear.

9. An electroluminescent display according to claim 6 further comprising a sensor generating a signal proportional to an electroluminescent display luminance for a particular driver voltage, said signal being used to adjust shapes of the positive and negative voltage ramps.

10. An electroluminescent display according to claim 9 wherein said sensor is a calibration pixel on said electroluminescent display.

* * * * *